US012644254B2

(12) United States Patent
Kenkel et al.

(10) Patent No.: US 12,644,254 B2
(45) Date of Patent: Jun. 2, 2026

(54) MANAGING TRANSITION BEHAVIOR BETWEEN CONTROL MODES ON A WORK MACHINE

(71) Applicant: Deere & Company, Moline, IL (US)

(72) Inventors: Aaron R. Kenkel, Hazel Green, WI (US); Jeffery W. Dobchuk, Saskatoon (CA)

(73) Assignee: Deere & Company, Moline, IL (US)

( * ) Notice: Subject to any disclaimer, the term of this patent is extended or adjusted under 35 U.S.C. 154(b) by 90 days.

(21) Appl. No.: 18/778,398

(22) Filed: Jul. 19, 2024

(65) Prior Publication Data

US 2026/0022534 A1 Jan. 22, 2026

(51) Int. Cl.
*E02F 9/20* (2006.01)

(52) U.S. Cl.
CPC ..... *E02F 9/2025* (2013.01)

(58) Field of Classification Search
CPC ..... E02F 9/2025
See application file for complete search history.

(56) References Cited

U.S. PATENT DOCUMENTS 5,001,645 A * 3/1991 Williams ..... F02P 5/045 123/436
5,157,613 A * 10/1992 Williams ..... F02P 5/045 123/406.23
6,792,344 B2 * 9/2004 Minowa ..... B60W 10/18 701/87
7,162,353 B2 * 1/2007 Minowa ..... B60W 30/188 701/84
9,108,670 B2 * 8/2015 Vigholm ..... E02F 9/225
9,464,410 B2 * 10/2016 Johnson ..... E02F 3/434
11,046,330 B1 * 6/2021 Katzourakis ..... B60W 10/20
11,363,756 B2 * 6/2022 Kuriyagawa ..... A01D 34/76
11,555,294 B2 1/2023 Hita et al.
11,845,453 B1 * 12/2023 Katzourakis ..... B60W 10/18
11,987,243 B2 * 5/2024 Asano ..... B60W 50/14
12,135,080 B2 * 11/2024 Vroemen ..... F16H 61/688
2006/0066268 A1 * 3/2006 Noro ..... B60L 15/2036 318/69
2012/0233993 A1 * 9/2012 Vigholm ..... E02F 9/2296 60/327
2012/0293316 A1 * 11/2012 Johnson ..... E02F 9/2087 340/438

(Continued)

*Primary Examiner* — Tyler J Lee
(74) *Attorney, Agent, or Firm* — Christopher J. Volkmann; KELLY, HOLT & CHRISTENSON PLLC

(57) ABSTRACT

A work machine has a plurality of different control systems. Each control system generates a request or control signal to control a controllable subsystem. A control supervisor selects which of the plurality of control systems is to control the controllable subsystem and provides feedback to the plurality of control systems indicating which of the plurality of control systems has been selected and a current control signal value. A time-based transition constraint processing system generates a time-based transition constraint that is used to control the transition from the current control signal value generated by the first control system, of the plurality of control systems, and to the selected control signal value generated by the selected control system. The selected control system controls the controllable subsystem based upon the time-based transition constraint.

20 Claims, 11 Drawing Sheets

(56) References Cited

U.S. PATENT DOCUMENTS

| | | | | |
|---|---|---|---|---|
| 2013/0173124 | A1* | 7/2013 | Palmer | F16H 61/0213 701/55 |
| 2013/0304291 | A1* | 11/2013 | Nawata | B60W 10/26 180/65.265 |
| 2014/0032026 | A1* | 1/2014 | Hancock | B60W 20/00 180/65.265 |
| 2018/0181124 | A1* | 6/2018 | Fukuda | G06F 11/302 |
| 2020/0390028 | A1* | 12/2020 | Kuriyagawa | F02D 37/02 |
| 2022/0003310 | A1* | 1/2022 | Vroemen | F16H 61/12 |
| 2022/0324447 | A1* | 10/2022 | Asano | B60W 30/182 |

* cited by examiner

MANAGING TRANSITION BEHAVIOR BETWEEN CONTROL MODES ON A WORK MACHINE

FIELD OF THE DESCRIPTION

The present description relates to work machines. More specifically, the present description relates to managing the transition between controlling the work machine with a first control system and controlling the work machine with a second control system.

BACKGROUND

There are many different types of work machines. Such work machines can include excavators, loaders, dozers, and any of a wide variety of other work machines.

Such work machines may have multiple different control modes or control systems that are capable of controlling the work machine. For instance, an excavator may have digging subsystems which are manually controllable by an operator in an operator compartment. However, excavators may also have grade control systems that are configured to automatically control the digging components of the excavator.

The discussion above is merely provided for general background information and is not intended to be used as an aid in determining the scope of the claimed subject matter.

SUMMARY

A work machine has a plurality of different control systems. Each control system generates a request or control signal to control a controllable subsystem. A control supervisor selects which of the plurality of control systems is to control the controllable subsystem and provides feedback to the plurality of control systems indicating which of the plurality of control systems has been selected and a current control signal value. A time-based transition constraint processing system generates a time-based transition constraint that is used to control the transition from the current control signal value generated by the first control system, of the plurality of control systems, and to the selected control signal value generated by the selected control system. The selected control system controls the controllable subsystem based upon the time-based transition constraint.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
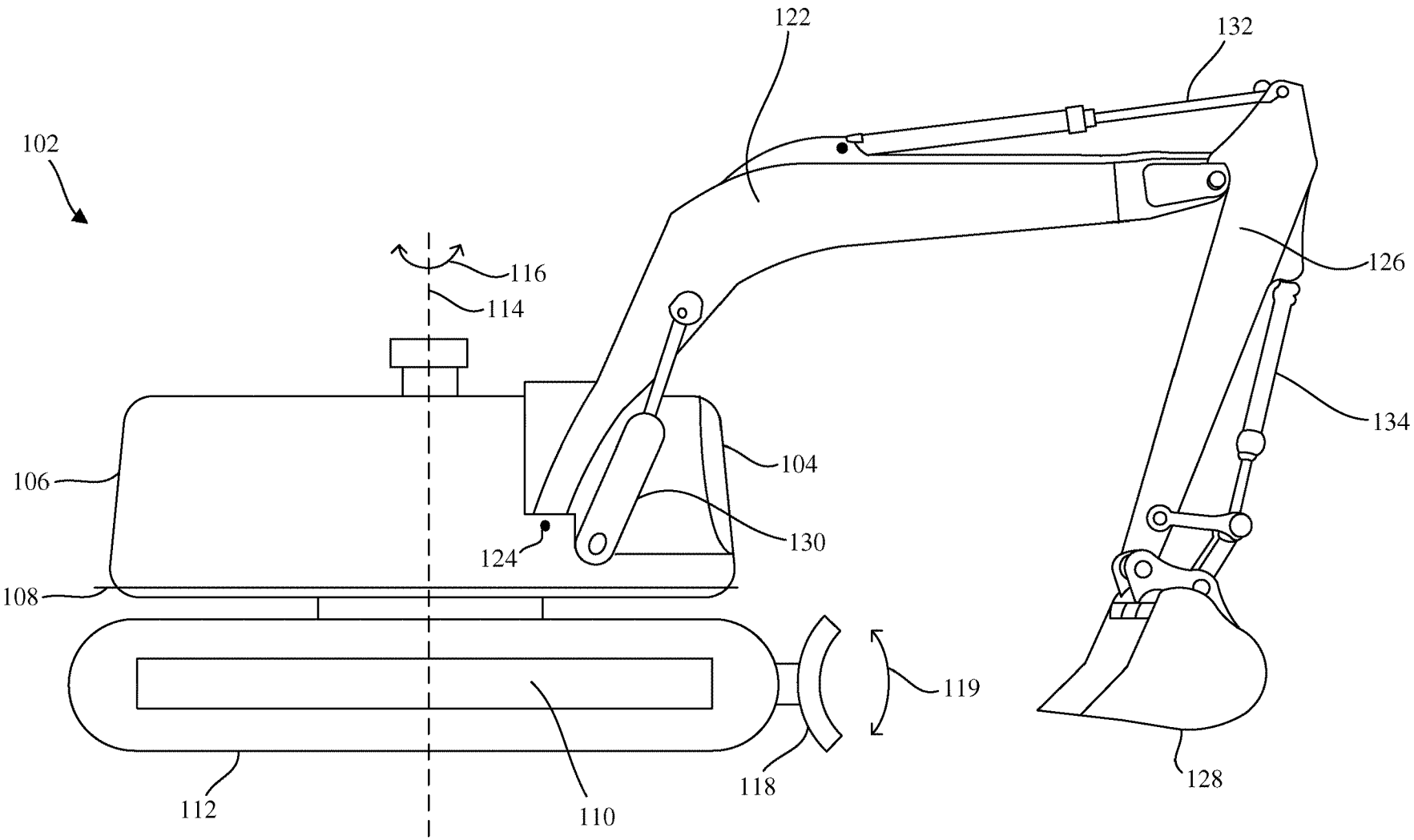
FIG. 1 is a side pictorial illustration of one example of a work machine.

For the purposes of promoting an understanding of the principles of the present disclosure, reference will now be made to the examples illustrated in the drawings, and specific language will be used to describe the same. It will nevertheless be understood that no limitation of the scope of the disclosure is intended. Any alterations and further modifications to the described devices, systems, methods, and any further application of the principles of the present disclosure are fully contemplated as would normally occur to one skilled in the art to which the disclosure relates. In particular, it is fully contemplated that the features, components, and/or steps described with respect to one example may be combined with the features, components, and/or steps described with respect to other examples of the present disclosure.

As discussed above, there are a wide variety of different types of work machines, and some work machines have multiple different control modes or control systems which can be used to control the work machine. For instance, an excavator may have a manual control system which allows an operator to provide manual inputs through input mechanisms (such as joysticks, pedals, levers, steering wheel, buttons, etc.). Control signals are generated based on the operator inputs in order to control one or more controllable subsystems on the work machine. The controllable subsystems may include such things as actuators for digging equipment, a propulsion subsystem, a steering subsystem, among others. An excavator may also have an automated control system, such as a grade control system which may receive inputs indicative of a current grade of a surface, as well as a desired grade, and automatically generate control signals to control the digging equipment based upon the inputs. Similarly, an excavator may have additional automated control systems, such as a virtual fence system which identifies a location proximate the excavator that the excavator will not be allowed to breach. By automatic it is meant, for example, that the operation or function is performed without further human involvement except, perhaps, to initiate or authorize the operation or function.

In some scenarios, a plurality of different control systems will issue competing or conflicting requests or control signals to a particular controllable subsystem. For instance, an operator may be manually operating an actuator that moves the digging equipment on an excavator to lower the digging equipment, but the grade control system may be issuing a request to stop the digging equipment from lowering any further, because it has reached a desired grade.

Thus, in one example, a machine control supervisor receives the requests or control signals from all of the different control systems used to control the controllable subsystem and selects a particular control system that will be used to control the controllable subsystem. However, this can also present difficulties. For instance, it may be that the current control signal that is generated by a first control system to control a controllable subsystem may have a value that is significantly different than a control signal generated by the newly selected control system. Transitioning from controlling the controllable subsystem with the first control system to controlling the controllable subsystem with the newly-selected control system can result in undesirable behavior.

For instance, if the control signal to control an actuator transitions too quickly or abruptly by a large magnitude, this can cause discomfort for the operator, as well as mechanical difficulties. However, transitioning too slowly can also result in undesirable behavior, such as overshoot of the actuator where the actuator travels to an undesirable position.

By way of a specific example, assume again that the operator is providing a manual input to lower an excavator bucket at a relatively high rate of speed. Also assume that the grade control system is issuing a command or control signal to stop or drastically reduce the velocity of the bucket because the bucket is approaching or has reached a desired grade. If the transition from the manual control system to the grade control system were abrupt, this would result in the bucket going from a first state in which it is moving at a relatively high velocity to a second state in which it is stopped instantaneously or abruptly. This can jolt the operator compartment and the operator, resulting in discomfort, and it can also result in additional mechanical wear or other mechanical strains on the machine. Further, if the transition is too slow, the bucket may overshoot the desired grade.

The present description thus provides a time-based position constraint processing system which controls the transition behavior when transitioning between controlling a controllable subsystem with a first control system to controlling the controllable subsystem with a second control system. The time-based transition constraint processing system identifies the magnitude of difference between a current control signal value (or request value) generated by the first control system and the control signal value (or request value) generated by the second, newly-selected control system. Based on that magnitude, the time-based transition request processing system identifies a time period over which the transition from the first control signal value to the second control signal value will be made. The time-based transition constraint is variable and can be tuned in aggressiveness (e.g., the time period for the transition can be made shorter or longer) based on a variety of different criteria, such as the magnitude of the difference between the two control signal values, the control systems that are issuing the two control signals, among other criteria.

Again, by way of example, if the first control system issuing the first request value is a manual control system, but the second control system is a virtual fence control system, then the transition between the two request values may be relatively aggressive (meaning that the time-based transition constraint is relatively short) because the virtual fence control system is attempting to avoid a collision or an impingement into a fenced-off area. However, if the two control systems are different control systems, and an overshoot or undershoot in the operation of the controllable subsystem is allowed, then the time-based transition constraint may be less aggressive (meaning that the transition from the first control signal value to the second request value can be longer).

FIG. 1 is a side view of one example of a work machine 102. Work machine 102 includes an operator compartment 104 which is mounted on an upper house 106. House 106 is supported by an upper frame 108 and rotatably coupled to a lower frame or undercarriage 110 which supports one or more ground-engaging traction elements 112 (in the example shown in FIG. 1, the traction elements are tracks, but the traction elements could be wheels or other traction elements). House 106 is driven by an actuator to rotate relative to undercarriage 110 about axis 114, as indicated by arrow 116. FIG. 1 also shows that, in one example, the undercarriage 110 supports a blade 118 which can be raised or lowered in the direction indicated by arrow 119 relative to the undercarriage 110.

FIG. 1 also shows that, in one example, a boom 122 is coupled to the frame 108 that supports house 106. Boom 122 rotates about a boom axis 124. Stick or arm 126 is rotatably coupled to boom 122. An attachment 128 (illustrated as a bucket) is attached to a distal end of stick 126. Movement of boom 122 relative to frame 108 can be driven by one or more actuators 130, which can be hydraulic actuators or other actuators. Movement of arm or stick 126 relative to boom 122 can also be driven by one or more actuators 132, and movement of attachment 128 relative to stick or arm 126 can be driven by one or more actuators 134. While a single track 112 is illustrated in FIG. 1, it will be appreciated that work machine 102 may have a plurality of tracks that are arranged in parallel relative to one another and mounted to under carriage 110 to provide movement of work machine 102 over the ground or other surface on which work machine 102 is operating.

In one example, work machine 102 can include a plurality of different control systems. A manual machine control system can be a control system that is operated through manual inputs from an operator in operator compartment 104. An automated machine control system can be a grade control system which controls actuators 130, 132, and 134 to control the position and movement of bucket 128 so that bucket 128 excavates material to a desired grade. For instance, the grade control system may provide inputs that are designed to control the actuators to move bucket 128 to remove material down to a desired elevation, but not beyond that elevation. Other automated machine control systems include geofencing systems that define geographic areas from which the machine 102 is to be excluded. Such an automated control system will control the various actuators on machine 102 to prevent any portion of the machine 102 from crossing into the fenced-off area.

The present discussion describes a control processing system that controls the transition between using a first control system to control machine 102 and using a second control system to control machine 102. The control processing system does this may imposing a time-based transition constraint which defines a time period over which the transition from controlling with the first control system to controlling with the second control system is transitioned.

Figure 2:
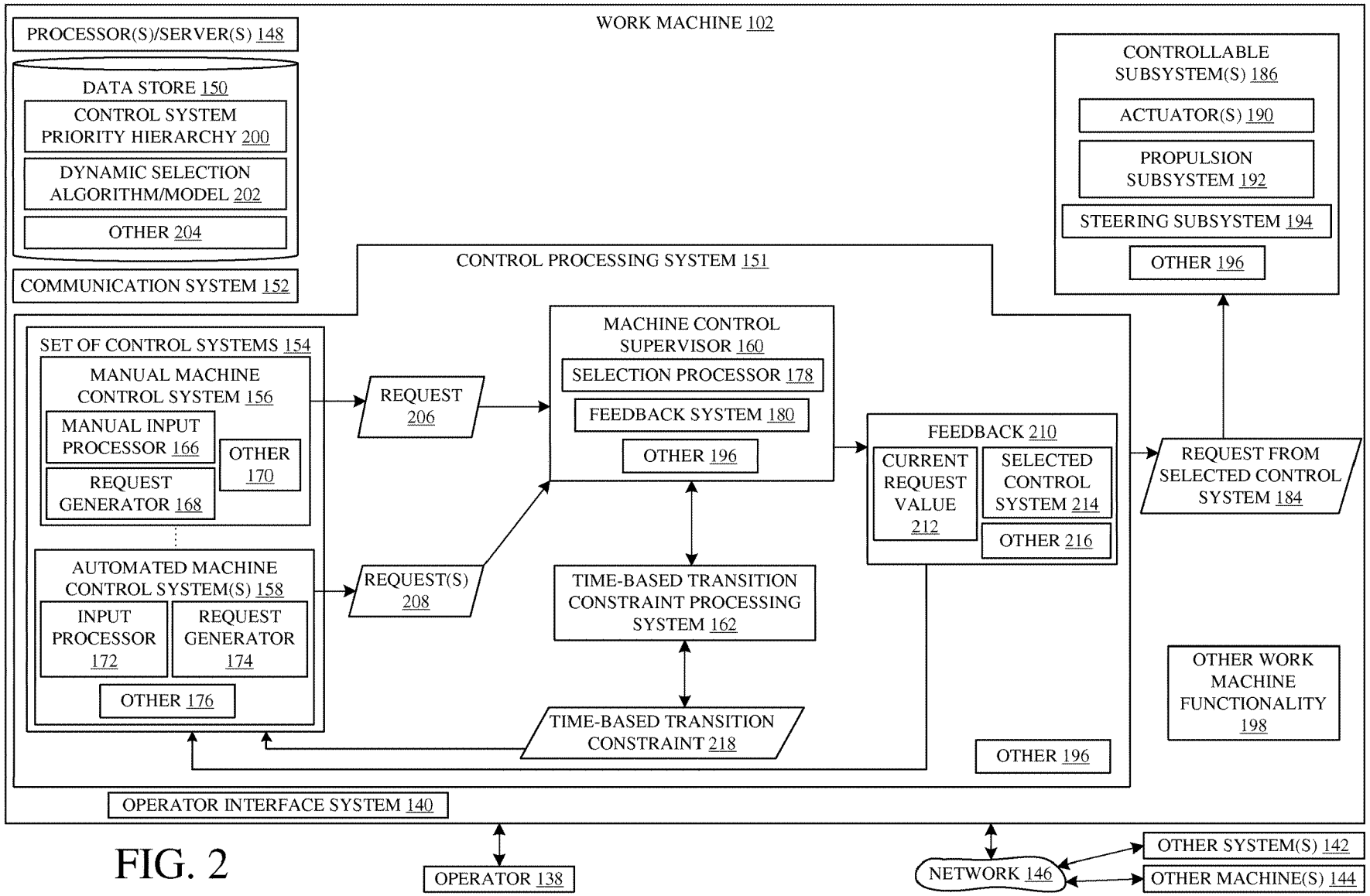
FIG. 2 is a block diagram showing one example of a work machine.

FIG. 2 is a block diagram showing one example of work machine 102, with some portions shown in more detail. In the example shown in FIG. 2, work machine 102 is operated in a manual control mode by an operator 138 which may provide inputs through an operator interface system 140. Operator interface system 140 may include operator interface mechanisms such as levers, joysticks, a steering wheel, pedals, linkages, display devices, or any of a wide variety of other mechanisms that provide audio, visual, and/or haptic outputs to operator 138 and receive inputs from operator 138.

FIG. 2 also shows that work machine 102 can communicate with other systems 142 and/or other machines 144 over network 146. Network 146 may be a local area network, a wide area network, a near field communication network, a Wi-Fi network, a Bluetooth network, a cellular communication network, or any of a wide variety of other networks or combinations of networks. Other systems 142 may be remote server systems, manager systems, vendor systems, or other systems. Other machines 144 may be other work machines, tender vehicles that provide maintenance, fuel, etc. to work machine 102, or other machines.

In the example shown in FIG. 2, work machine 102 includes one or more processors or servers 148, data store 150, control processing system 151, communication system 152, controllable subsystem(s) 186, and other work machine functionality 198.

Control processing system 151 includes a set of control systems 154 that can 22 include a manual machine control system 156, and one or more automated machine control systems 158. Control processing system 151 also includes machine control supervisor 160, time-based transition constraint processing system 162, and any of a wide variety of other items 164. Manual machine control system 156 can include manual input processor 166, request generator 168, and other items 170. The automated machine control systems 158 can each include an input processor 172, request generator 174, and other items 176. Machine control supervisor 160 includes selection processor 178, feedback system 180, and other items 182. Control processing system 151 provides a request (or control signal) 184 from a selected control system 156-158 to one or more controllable subsystems 186.

Controllable subsystems 186 can include actuators 190 (which may include one or more of the actuators 130, 132, and 134 from FIG. 1 or other actuators), propulsion subsystem 192, steering subsystem 194, and other items 196. Before describing the overall operation of work machine 102 and control processing system 151, a description of some of the items in work machine 102, and their operation, will first be provided.

Data store 150 can store a control system priority hierarchy 200 and/or a dynamic selection algorithm or model 202 as well as other items 204. The control system priority hierarchy 200 defines a hierarchy of the different control systems 156-158 in the set of control systems 154 which will be selected by machine control supervisor 160 under different circumstances. Dynamic selection algorithm/model 202 can be invoked or run by selection processor 178 in machine control supervisor 160 to identify which machine control system 156-158 should be selected and used to control one or more of the controllable subsystems 186.

Communication system 152 facilitates the communication of the items of work machine 102 with one another and may also facilitate communication with other systems 142, other machines 144, or other items over network 146. Therefore, communication system 152 can be a controller area network (CAN) bus and bus controller, a cellular communication system, a wide area network communication system or local area network communication system, a Bluetooth, near field, or Wi-Fi communication system, or any of a wide variety of other communication systems or combinations of systems.

Manual control system 156 receives manual inputs through operator interface system 140 and manual input processor 166 processes those inputs to determine what type of control operation is being requested by the operator. Request generator 168 then generates a request or control signal 206 which can be used to control one or more of the controllable subsystems 186. The request 206, for instance, may include a value indicative of how a particular actuator 190 is to be controlled.

Automated machine control system 158 may receive automated inputs from sensors or other systems and input processor 170 processes those inputs to determine what type of request is to be made to control a controllable subsystem 186. Request generator 174 generates that request or control signal 208 which can be applied to the desired controllable subsystem 186 to control that controllable subsystem 186.

At certain times, a plurality of different control systems, in the set of control systems 154, generate requests to control the same controllable subsystem (e.g., the same actuator 190). For instance, operator 138 may be manually controlling actuator 190 to lower bucket 128 to a desired elevation. At the same time, a grade control system (e.g., an automated machine control system 158) may generate another request 208 to preclude bucket 128 from descending any further, because it has reached the desired elevation based upon a desired grade. In that case, requests 206 and 208 may both be attempting to control the same actuator 190, but may have different values.

Machine control supervisor 160 decides which machine control system 156 or 158 should be selected to control the actuator 190. Selection processor 178 accesses control system priority hierarchy 200 or runs dynamic selection algorithm/model 202 to determine which of the control systems 156-158 should be selected. Once that control system is selected, feedback system 180 generates feedback 210 which is provided to all of the control systems in the set of control systems 154. The feedback includes a current request value 210 which identifies the value of the request 184, that is currently being used to control actuator 190, as well as the selected control system identifier 214 that identifies the control system of the set of control system 154 that has been selected by machine control supervisor 160 to control actuator 190. Feedback 210 can include other items 216 as well.

When machine control supervisor 160 switches the control system that is to control actuator 190, then time-based transition constraint processing system 162 generates a time-based transition constraint 218 and feeds time-based transition constraint 218 back to the selected control system so that the selected control system transitions from the current request value to its own request value over a time period defined by the time-based transition constraint 218. The selected control system then generates requests or control signals based on the time-based transition constraint 218 to transition from the current request value to its desired request value over the time period defined by the time-based transition constraint 218.

Figure 3:
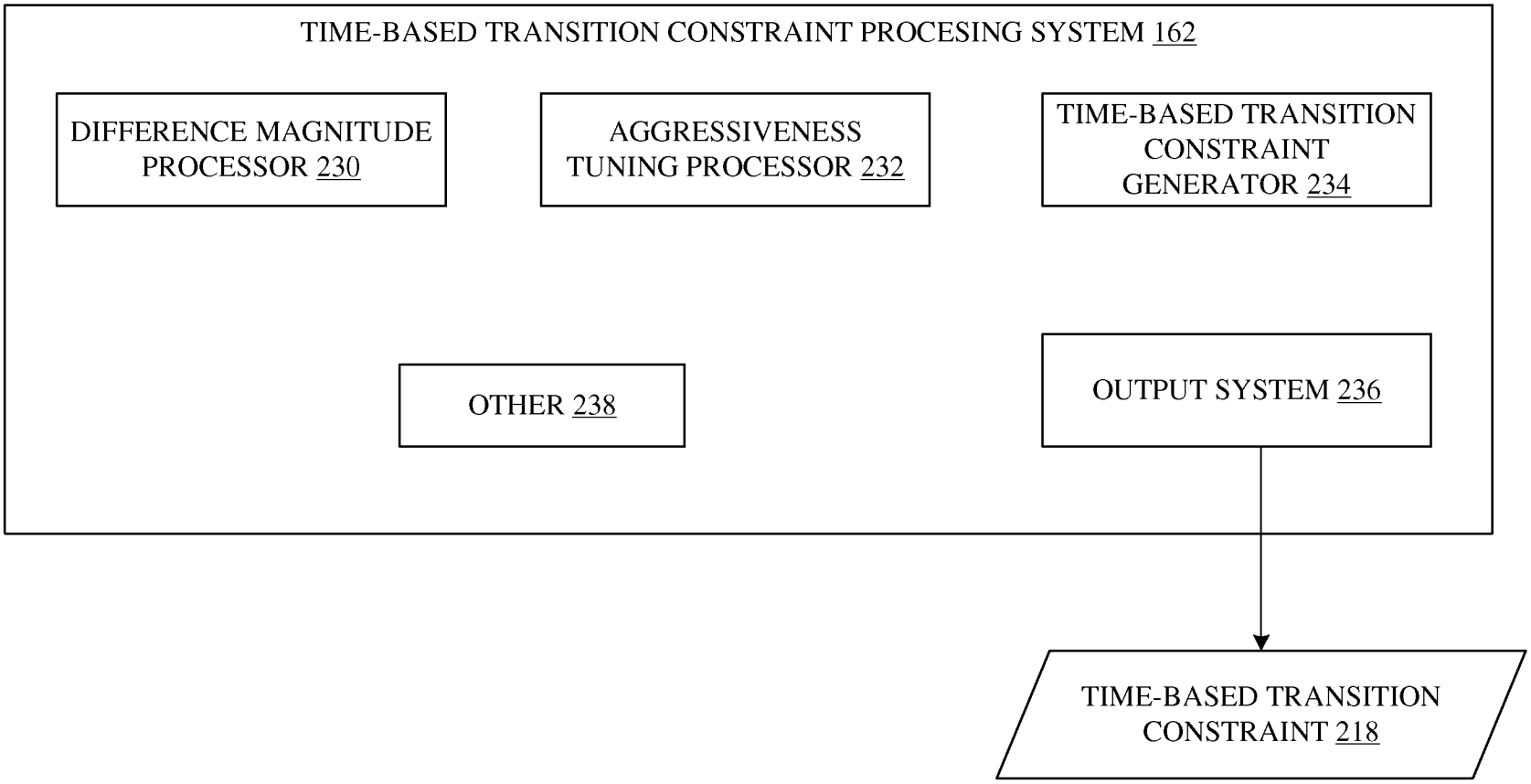
FIG. 3 is a block diagram showing one example of a time-based transition constraint processing system.

FIG. 3 is a block diagram showing one example of time-based transition constraint processing system 162 in more detail. Time-based transition constraint processing system 162 includes difference magnitude processor 230, aggressiveness tuning processor 232, time-based transition constraint generator 234, output system 236, and other items 238. Difference magnitude processor 230 identifies the magnitude of the difference between the current request value (or control signal value) and the request value (or control signal value) being generated by the newly selected control system.

Aggressiveness tuning processor 232 identifies how aggressively the transition should be made between the two values. For instance, aggressiveness tuning processor 232 may determine the aggressiveness based on the control systems that are generating the two requests. If the newly selected control system is a geofencing system, then the transition may be quite aggressive so that machine 102 does not infringe on a fenced area. If the newly selected control system is a grade control system, then the aggressiveness of the transition between the two values may be tuned to be less aggressive because a minor overshoot or undershoot may be acceptable. These are only examples. Based on the magnitude of the difference between the two request values and based upon the aggressiveness identified by aggressiveness tuning processor 232, time-based transition constraint generator 234 generates the time-based transition constraint 218 which identifies the period over which the transition from the current request value to the newly selected request value will be made.

Figure 4A:
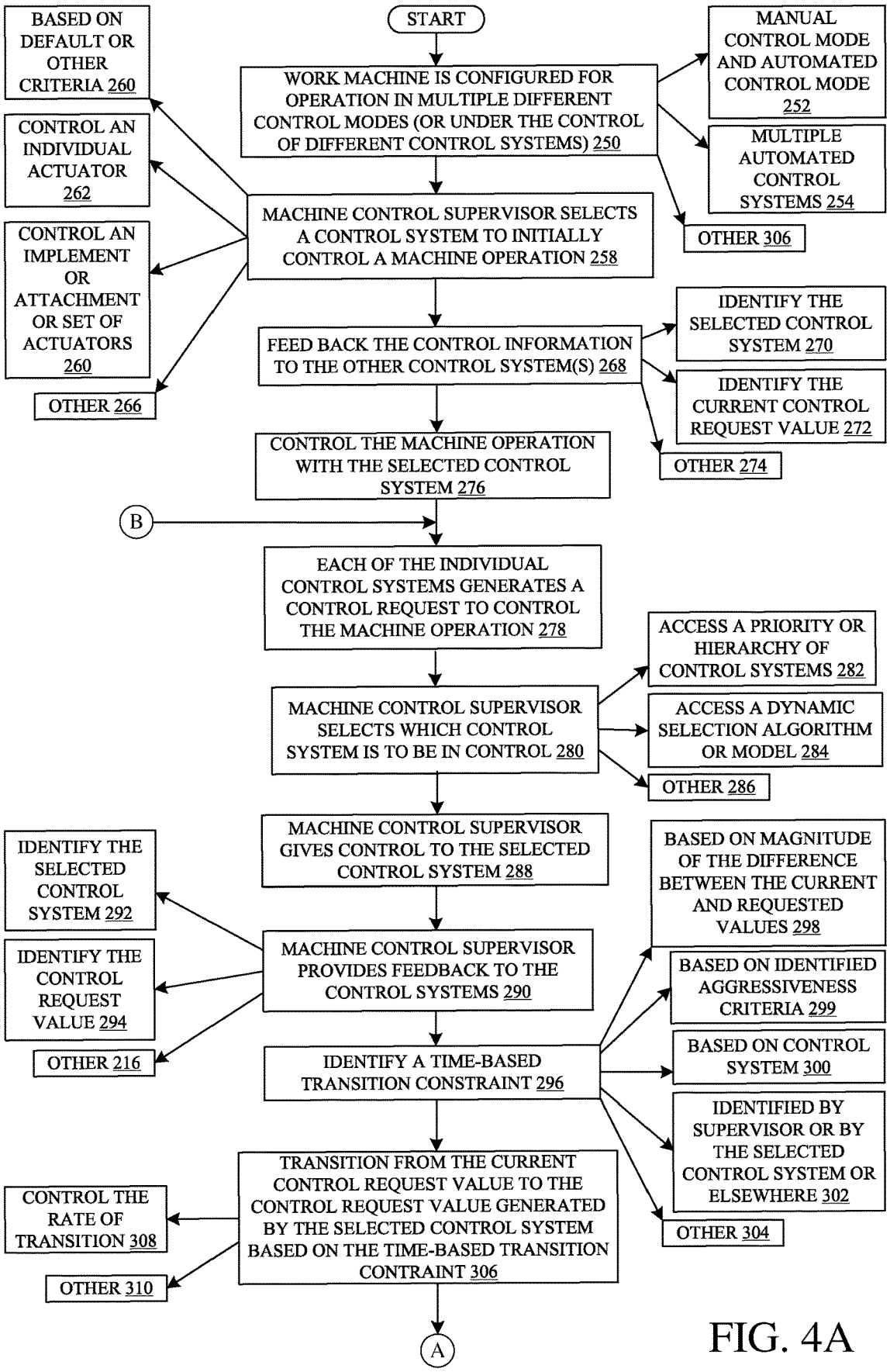
FIGS. 4A and 4B (collectively referred to herein as FIG. 4) show a flow diagram illustrating one example of the operation of the work machine based on a time-based transition constraint.
Figure 4B:
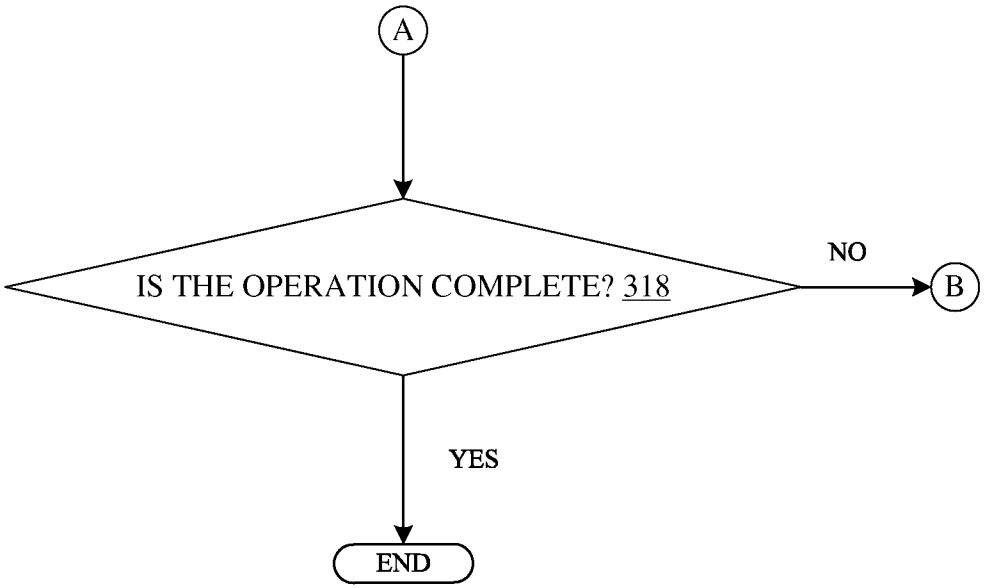

FIGS. 4A and 4B (collectively referred to herein as FIG. 4) show a flow diagram illustrating one example of the operation of work machine 102 and control processing system 151 in more detail. FIG. 4 will now be described in conjunction with FIGS. 2 and 3.

It is first assumed that work machine 102 is configured for operation in multiple different control modes (or under the control of multiple different control systems in a set of control systems 154). Having machine 102 configured in this way is indicated by block 250 in the flow diagram of FIG. 4. In one example, the set of control systems 154 includes a manual machine control system 156 and an automated machine control system 158, as indicated by block 252. In another example, the set of control systems 154 includes a plurality of automated machine control systems 158, as indicated by block 254. Different combinations of different types of control systems can be used as well, as indicated by block 256.

Initially, machine control supervisor 160 selects one of the control systems in the set of control systems 154 to perform initial control of machine operation. Selecting a control system for initial control is indicated by block 258 in the flow diagram of FIG. 4. The initially-selected machine control system may be selected by default or using other criteria, as indicated by block 260. The selected control system may be selected to control an individual actuator 190, as indicated by block 262, or to control an implement or attachment or a set of plurality of different actuators or other controllable subsystems as indicated by blocks 264 and 266 in the flow diagram of FIG. 4.

The machine control supervisor 160 uses feedback system 180 to generate feedback 210 which feeds back the control information to the control systems in the set of control systems 154. Generating feedback is indicated by block 268 in the flow diagram of FIG. 4. The feedback 210 identifies the selected control system 214 as indicated by block 270. The feedback 210 identifies the current request value 212, as indicated by block 272. The feedback can include other items 274 as well.

Control processing system 151 then outputs requests or control signals 184 from the selected control system to control controllable subsystems 186. Outputting a request or control signal from the selected control system is indicated by block 276 in the flow diagram of FIG. 4.

During operation of the work machine 102, each of the individual control systems 156-158 in the set of control systems 154 generate a control request 206-208 to control the particular controllable subsystem or machine operation as indicated by block 278 in the flow diagram of FIG. 4.

Machine control supervisor 160 then selects which of the particular control systems is to be in control of the particular machine actuator or machine operation or controllable subsystem 186. Selecting the control system to control the machine operation or actuator or controllable subsystem 186 is indicated by block 280 in the flow diagram of FIG. 4. In order to select one of the control systems 156-158, selection processor 178 can access a priority hierarchy of control systems 200, as indicated by block 282 in the flow diagram of FIG. 4. The control system priority hierarchy 200 may be a default hierarchy or a hierarchy set by operator 138 or another person or system, the priority hierarchy 200 may differ based upon the work machine 102, based upon the job that the work machine 102 is performing, based upon the particular controllable subsystem 186 being controlled, or based on any of a wide variety of other criteria. In another example, selection processor 178 can access a dynamic selection algorithm or model 202, as indicated by block 284 in the flow diagram of FIG. 4. The dynamic selection algorithm or model 202 may receive sensor inputs and other inputs indicative of a state of work machine 102 and indicative of the particular control systems 156-158 that are deployed on work machine 102. The dynamic selection algorithm or model 202 can receive any of a wide variety of other inputs and may be an artificial intelligence or machine learning model, a rules-based model, or any of a wide variety of other algorithms or models that can receive inputs and provide an output indicative of a selected control system. Selection processor 178 may select the control system using other components, or in other ways as well, as indicated by block 286. Once the selection processor 178 selects one of the machine control systems, then machine control supervisor 160 generates an output to provide the request from the selected machine control system to the controllable subsystem 186, as indicated by block 288 in the flow diagram of FIG. 4.

Feedback system 180 generates feedback 210 and provides that feedback 210 to the control systems 154, as indicated by block 290 in the flow diagram of FIG. 4. The feedback 210 includes an identifier 214 that identifies the selected control system, as indicated by block 292 in the flow diagram of FIG. 4. The feedback 210 also generates an output identifying the current request value 212, as indicated by block 294 in the flow diagram of FIG. 4. The feedback 210 can include other items 216 as well.

Time-based transition constraint processing system 162 identifies a time-based transition constraint for transition from a current request value to the request value generated by the newly selected control system. Generating the time-based transition constraint is indicated by block 296 in the flow diagram of FIG. 4. In one example, the time-based transition constraint processing system 162 may be deployed in each of the control systems in the set of control systems 154 so that each control system can generate its own time-based transition constraint. In another example, all or part of system 162 can be deployed in machine control supervisor 160 or elsewhere. In another example, the aggressiveness tuning processor 234 may be deployed in each of the control systems. Other parts of the time-based transition constraint processing system 162 can be deployed in each of the control systems or elsewhere as well. In another example, and in the example shown in FIG. 2, the time-based transition constraint processing system 162 is separate from the control systems 154 and separate from machine control supervisor 160 and generates the time-based transition constraint 218 which is provided to the control systems 154.

As discussed above with respect to FIG. 3, the difference magnitude processor 230 identifies the magnitude of the difference between the current request value and the request value output from the newly selected control system. Having the time-based transition constraint based on the magnitude of the two request values is indicated by block 298 in the flow diagram of FIG. 4. Aggressiveness tuning processor 232 then tunes the aggressiveness of the transition. The aggressiveness may be based upon aggressiveness criteria, such as which control system is the current control system and which is the newly selected control system as indicated by block 300 in the flow diagram of FIG. 4. Identifying the time-based transition constraint 218 can be performed in other ways as well, as indicated by block 304 in the flow diagram of FIG. 4.

The selected machine control system then transitions from the current control request value to the control request value generated by the selected control system based upon the time-based transition constraint, as indicated by block 306 in the flow diagram of FIG. 4. The time-based transition constraint is used to control the rate of transition between the current request value and the request value generated by the newly selected control system, as indicated by block 308. The transition can be controlled in other ways as well, as indicated by block 310.

Figure 5:
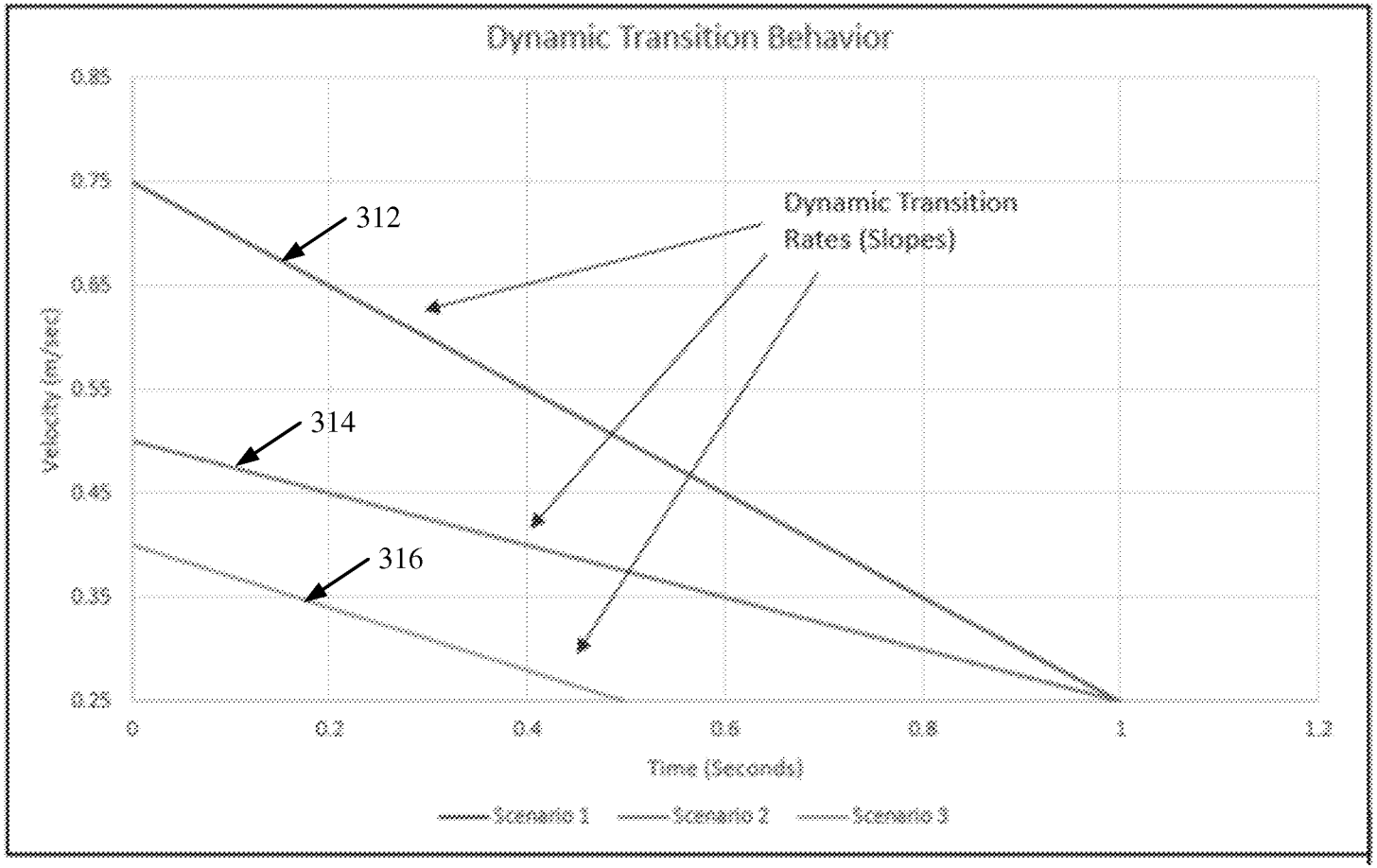
FIG. 5 is a graphical illustration of examples of dynamic transition behavior.

FIG. 5 is a graph illustrating one example of different values of the variable time-based transition constraint. In the example shown in FIG. 5, three transition scenarios are identified. The request values are illustrated in terms of velocity (e.g., meters per second) that are used to control an actuator in work machine 102. For instance, a request value of 0.75 meters per second commands the actuator to move in a given direction at the specified velocity. FIG. 5 shows transitions represented by the lines 312, 314, and 316, each having a different slope. The first line 312 identifies a transition from a first request value of 0.5 meters per second to a second request value of 0.25 meters per second over a time-based transition constraint of one second. The second line 314 identifies a smaller magnitude transition over the same time period. Specifically, line 314 represents a transition from a request value of 0.5 meters per second to a request value of 0.25 meters per second over the same one second time-based transition constraint as with line 312. FIG. 5 shows that the transition represented by line 312 is more aggressive than the transition represented by line 314. The difference in aggressiveness is indicated by the difference in slope of the two lines. Where the slope is steeper, this indicates a more aggressive transition because the magnitude of the transition over the time period indicated by the time-based transition constraint is greater.

Line 316 represents a transition from a request value of 0.4 meters per second to a request value of 0.25 meters per second over a time-based transition constraint of 0.5 seconds. Thus, the aggressiveness of the transition represented by line 316 is between the aggressiveness of the transition represented by line 312 and the aggressiveness of the transition represented by line 314.

Referring again to FIG. 4, until the operation being performed by machine 102 is complete (as determined at block 318), processing reverts to block 278 in the flow diagram of FIG. 4. It will be appreciated that the time basis for the transitions can vary dynamically as a function of the state of the automation system initiating the transition. For instance, the time basis can vary as a function of the distance to a desired surface in a grade control application (where a more aggressive transition will reduce the likelihood of an overshoot, etc.). The variable nature of the time-based transition constraint enhances the operation by making the response to a transition tunable to different scenarios, different control systems, etc. This is a significant advantage over a transition control system that uses a pre-determined rate of change between the request value of a current control system and the request value of a newly selected control system. Such a constant rate change results in a common transition slope across various scenarios which is not adaptable, dynamically, to different scenarios.

The present discussion has mentioned processors and servers. In one example, the processors and servers include computer processors with associated memory and timing circuitry, not separately shown. The processors or servers are functional parts of the systems or devices to which they belong and are activated by, and facilitate the functionality of the other components or items in those systems.

Also, a number of user interface displays (UI) have been discussed. The US displays can take a wide variety of different forms and can have a wide variety of different user actuatable input mechanisms disposed thereon. For instance, the user actuatable input mechanisms can be text boxes, check boxes, icons, links, drop-down menus, search boxes, etc. The mechanisms can also be actuated in a wide variety of different ways. For instance, the mechanisms can be actuated using a point and click device (such as a track ball or mouse). The mechanisms can be actuated using hardware buttons, switches, a joystick or keyboard, thumb switches or thumb pads, etc. The mechanisms can also be actuated using a virtual keyboard or other virtual actuators. In addition, where the screen on which the mechanisms are displayed is a touch sensitive screen, the mechanisms can be actuated using touch gestures. Also, where the device that displays the mechanisms has speech recognition components, the mechanisms can be actuated using speech commands.

A number of data stores have also been discussed. It will be noted the data stores can each be broken into multiple data stores. All can be local to the systems accessing the data stores, all can be remote, or some can be local while others are remote. All of these configurations are contemplated herein.

Also, the figures show a number of blocks with functionality ascribed to each block. It will be noted that fewer blocks can be used so the functionality is performed by fewer components. Also, more blocks can be used with the functionality distributed among more components.

It will be noted that the above discussion has described a variety of different systems, components, generators, and/or logic. It will be appreciated that such systems, components, generators, and/or logic can be comprised of hardware items (such as processors and associated memory, or other processing components, some of which are described below) that perform the functions associated with those systems, components, generators, and/or logic. In addition, the systems, components, generators, and/or logic can be comprised of software that is loaded into a memory and is subsequently executed by a processor or server, or other computing component, as described below. The systems, components, generators, and/or logic can also be comprised of different combinations of hardware, software, firmware, etc., some examples of which are described below. These are only some examples of different structures that can be used to form the systems, components, generators, and/or logic described above. Other structures can be used as well.

Figure 6:
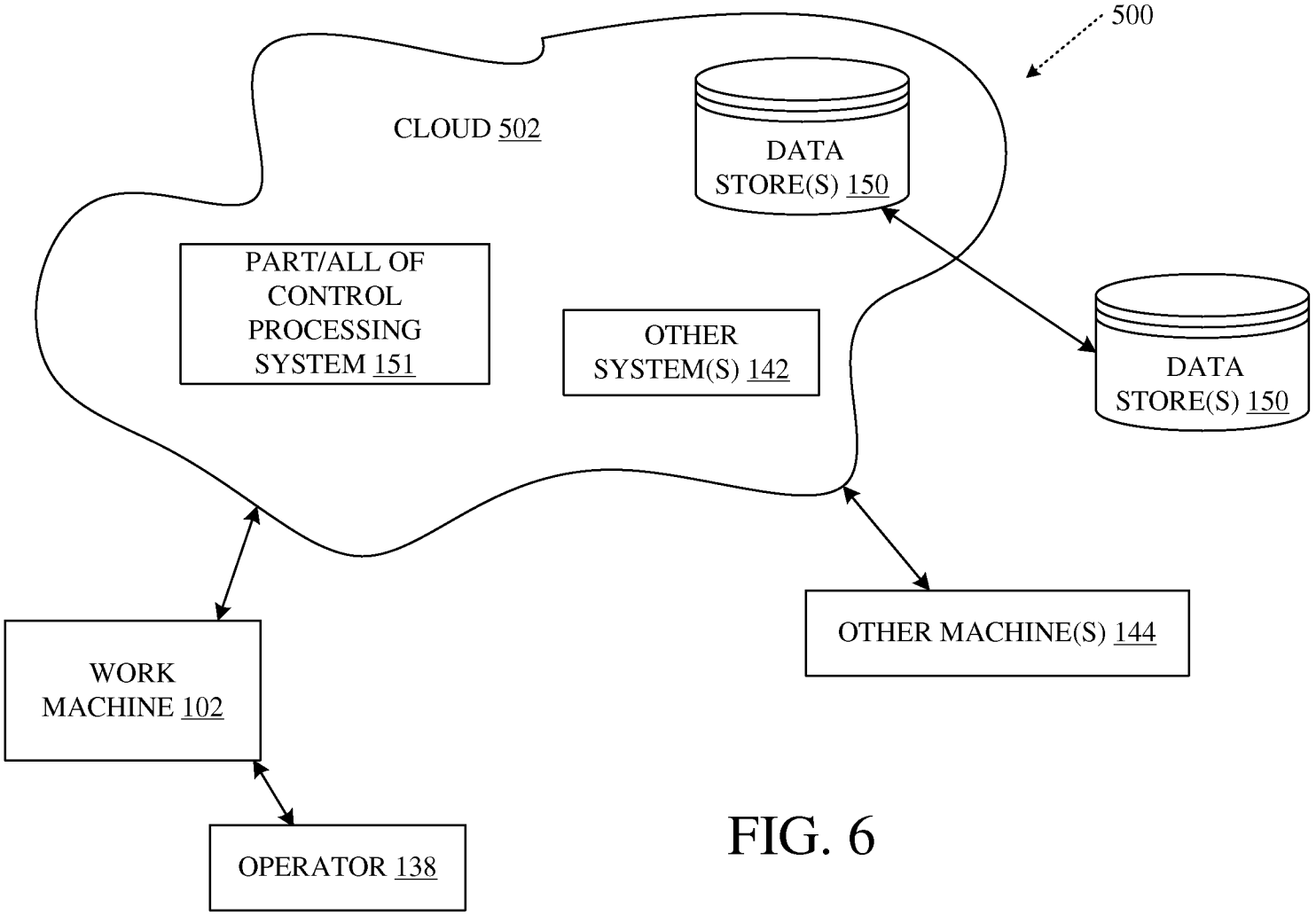
FIG. 6 is a block diagram showing one example of a work machine system deployed in a remote server architecture.

FIG. 6 is a block diagram of work machine 102, shown in FIG. 1, except that it communicates with elements in a remote server architecture 500. In an example, remote server architecture 500 can provide computation, software, data access, and storage services that do not require end-user knowledge of the physical location or configuration of the system that delivers the services. In various examples, remote servers can deliver the services over a wide area network, such as the internet, using appropriate protocols. For instance, remote servers can deliver applications over a wide area network and they can be accessed through a web browser or any other computing component. Software or components shown in previous FIGS. as well as the corresponding data, can be stored on servers at a remote location. The computing resources in a remote server environment can be consolidated at a remote data center location or they can be dispersed. Remote server infrastructures can deliver services through shared data centers, even though they appear as a single point of access for the user. Thus, the components and functions described herein can be provided from a remote server at a remote location using a remote server architecture. Alternatively, the components and functions can be provided from a conventional server, or they can be installed on client devices directly, or in other ways.

In the example shown in FIG. 6, some items are similar to those shown in previous FIGS. and they are similarly numbered. FIG. 6 specifically shows that parts or all of system 151, system(s) 142, and data store 150 can be located at a remote server location 502. Therefore, machine 102 accesses those systems through remote server location 502.

FIG. 6 also depicts another example of a remote server architecture. FIG. 6 shows that it is also contemplated that some elements of previous FIGS. are disposed at remote server location 502 while others are not. By way of example, data store 150 or other systems 142 can be disposed at a location separate from location 502, and accessed through the remote server at location 502. Regardless of where the items are located, they can be accessed directly by machine 102, through a network (either a wide area network or a local area network), the items can be hosted at a remote site by a service, or the items can be provided as a service, or accessed by a connection service that resides in a remote location. Also, the data can be stored in substantially any location and intermittently accessed by, or forwarded to, interested parties. All of these architectures are contemplated herein.

It will also be noted that the elements of previous FIGS., or portions of them, can be disposed on a wide variety of different devices. Some of those devices include servers, desktop computers, laptop computers, tablet computers, or other mobile devices, such as palm top computers, cell phones, smart phones, multimedia players, personal digital assistants, etc.

Figure 7:
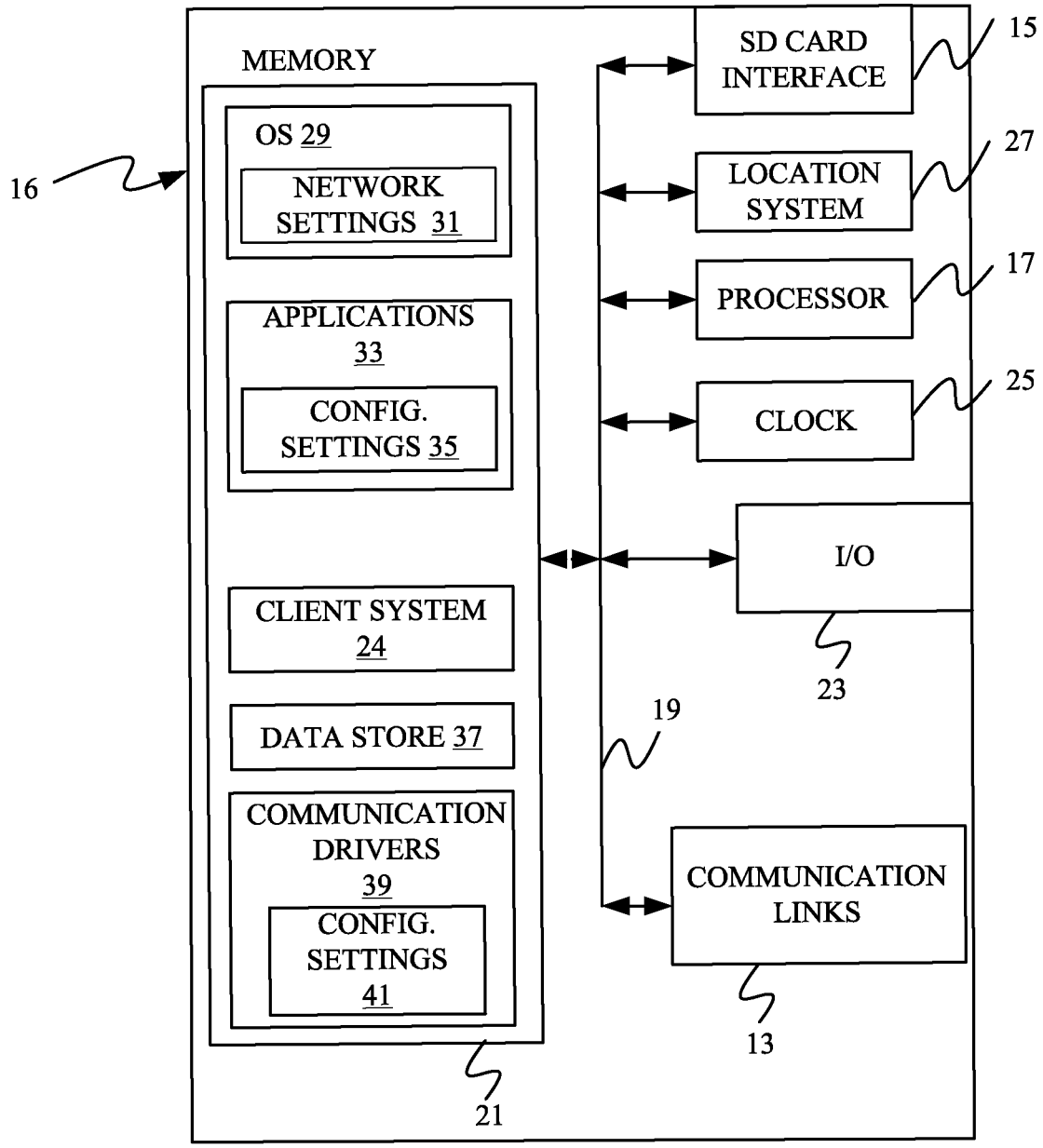
FIGS. 7-9 show examples of mobile devices that can be used in the systems and architectures described in other figures.
Figure 8:
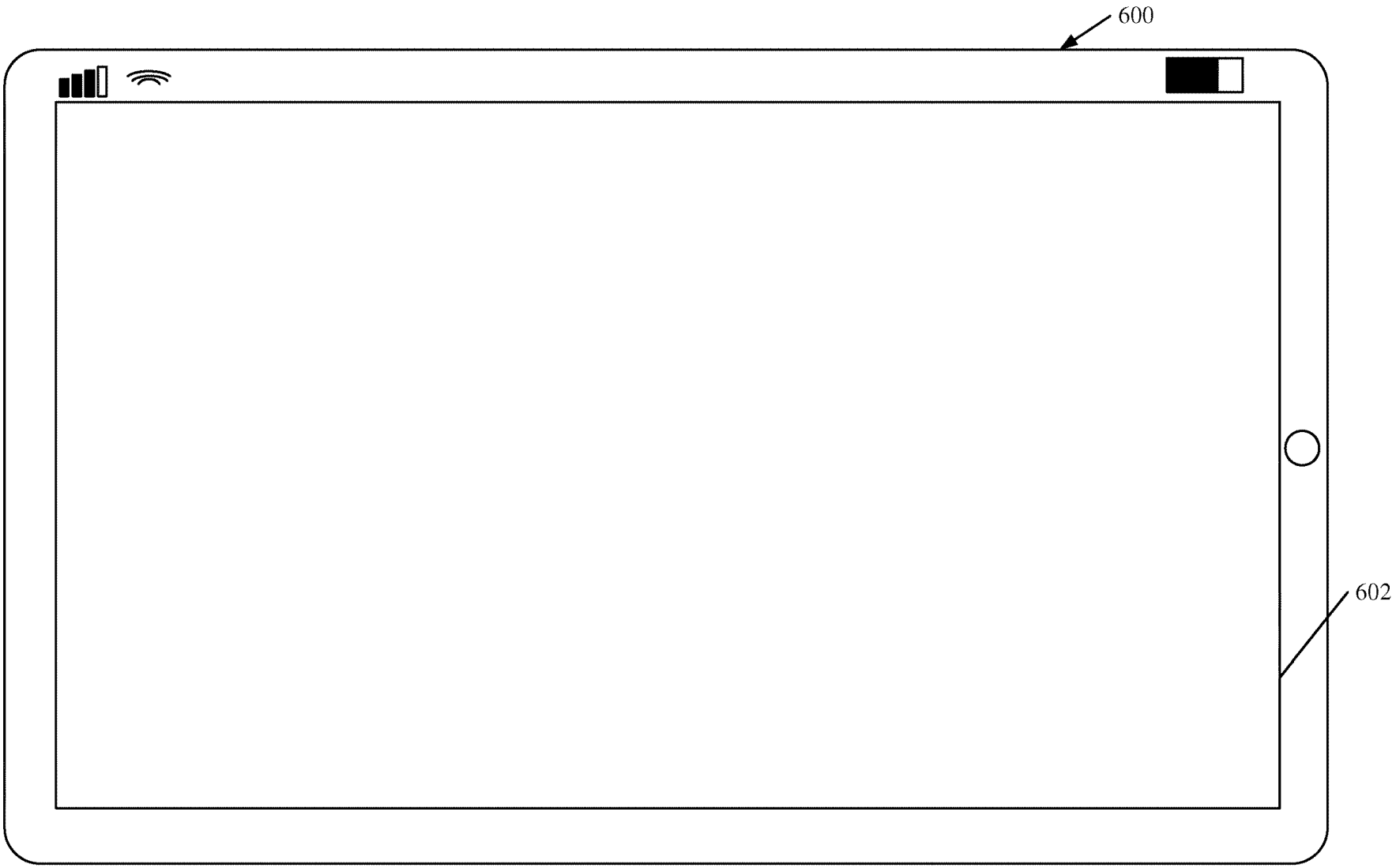
Figure 9:
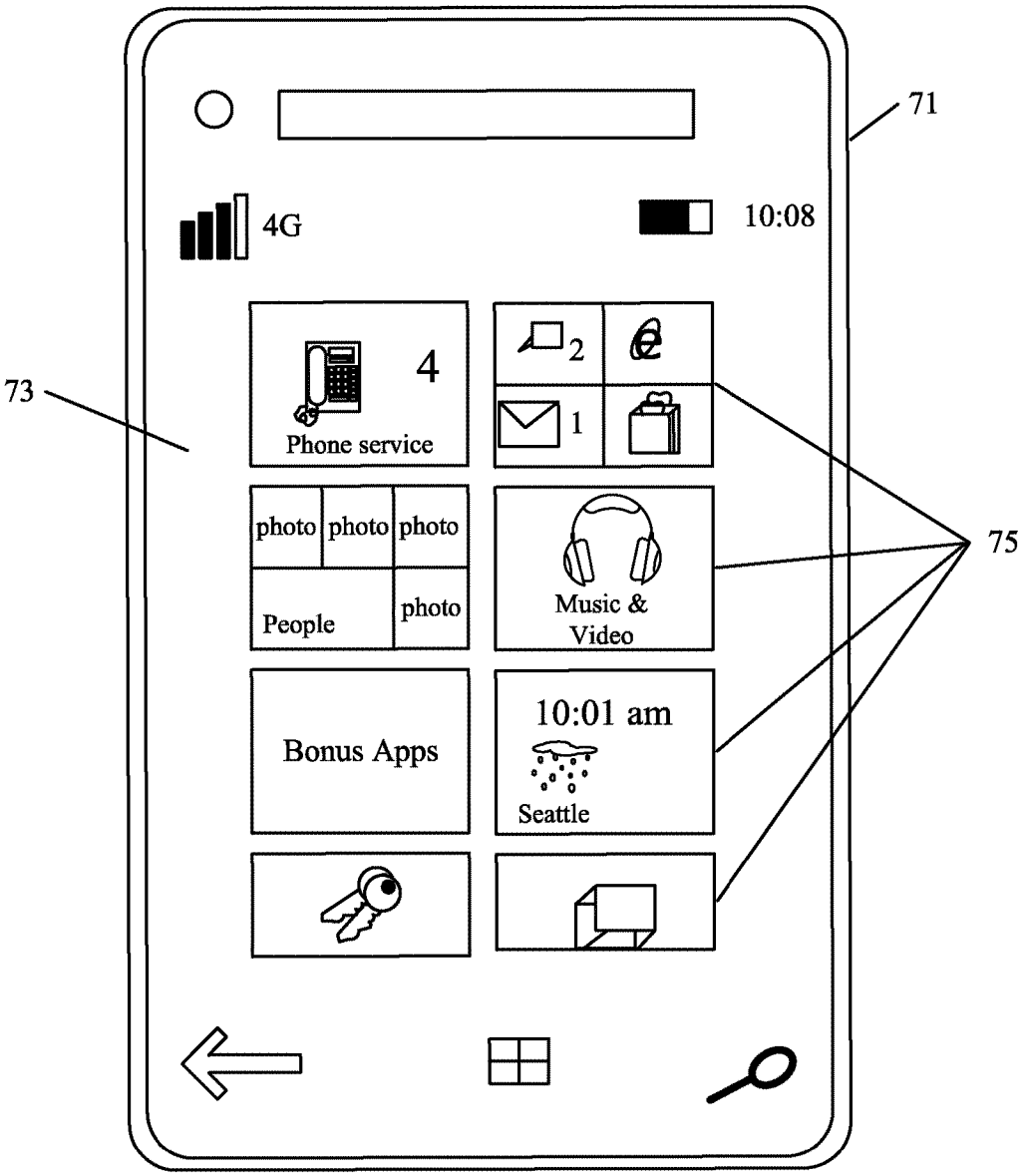

FIG. 7 is a simplified block diagram of one illustrative example of a handheld or mobile computing device that can be used as a user's or client's hand held device 16, in which the present system (or parts of it) can be deployed. For instance, a mobile device can be deployed in the operator compartment of machine 102 for use in generating, processing, or displaying the control data. FIGS. 8-9 are examples of handheld or mobile devices.

FIG. 7 provides a general block diagram of the components of a client device 16 that can run some components shown in previous FIGS., that interacts with them, or both. In the device 16, a communications link 13 is provided that allows the handheld device to communicate with other computing devices and under some examples provides a channel for receiving information automatically, such as by scanning. Examples of communications link 13 include allowing communication though one or more communication protocols, such as wireless services used to provide cellular access to a network, as well as protocols that provide local wireless connections to networks.

In other examples, applications can be received on a removable Secure Digital (SD) card that is connected to an interface 15. Interface 15 and communication links 13 communicate with a processor 17 (which can also embody processors or servers from previous FIGS.) along a bus 19 that is also connected to memory 21 and input/output (I/O) components 23, as well as clock 25 and location system 27.

I/O components 23, in one example, are provided to facilitate input and output operations. I/O components 23 for various examples of the device 16 can include input components such as buttons, touch sensors, optical sensors, microphones, touch screens, proximity sensors, accelerometers, orientation sensors and output components such as a display device, a speaker, and or a printer port. Other I/O components 23 can be used as well.

Clock 25 illustratively comprises a real time clock component that outputs a time and date. It can also, illustratively, provide timing functions for processor 17.

Location system 27 illustratively includes a component that outputs a current geographical location of device 16. This can include, for instance, a global positioning system (GPS) receiver, a dead reckoning system, a cellular triangulation system, or other positioning system. Location system 27 can also include, for example, mapping software or navigation software that generates desired maps, navigation routes and other geographic functions.

Memory 21 stores operating system 29, network settings 31, applications 33, application configuration settings 35, data store 37, communication drivers 39, and communication configuration settings 41. Memory 21 can include all types of tangible volatile and non-volatile computer-readable memory devices. Memory 21 can also include computer storage media (described below). Memory 21 stores computer readable instructions that, when executed by processor 17, cause the processor to perform computer-implemented steps or functions according to the instructions. Processor 17 can be activated by other components to facilitate their functionality as well.

FIG. 8 shows one example in which device 16 is a tablet computer 600. In FIG. 8, computer 600 is shown with user interface display screen 602. Screen 602 can be a touch screen or a pen-enabled interface that receives inputs from a pen or stylus. Computer 600 can also use an on-screen virtual keyboard. Of course, computer 600 might also be attached to a keyboard or other user input device through a suitable attachment mechanism, such as a wireless link or USB port, for instance. Computer 600 can also illustratively receive voice inputs as well.

FIG. 9 shows that the device can be a smart phone 71. Smart phone 71 has a touch sensitive display 73 that displays icons or tiles or other user input mechanisms 75. Mechanisms 75 can be used by a user to run applications, make calls, perform data transfer operations, etc. In general, smart phone 71 is built on a mobile operating system and offers more advanced computing capability and connectivity than a feature phone.

Note that other forms of the devices 16 are possible.

Figure 10:
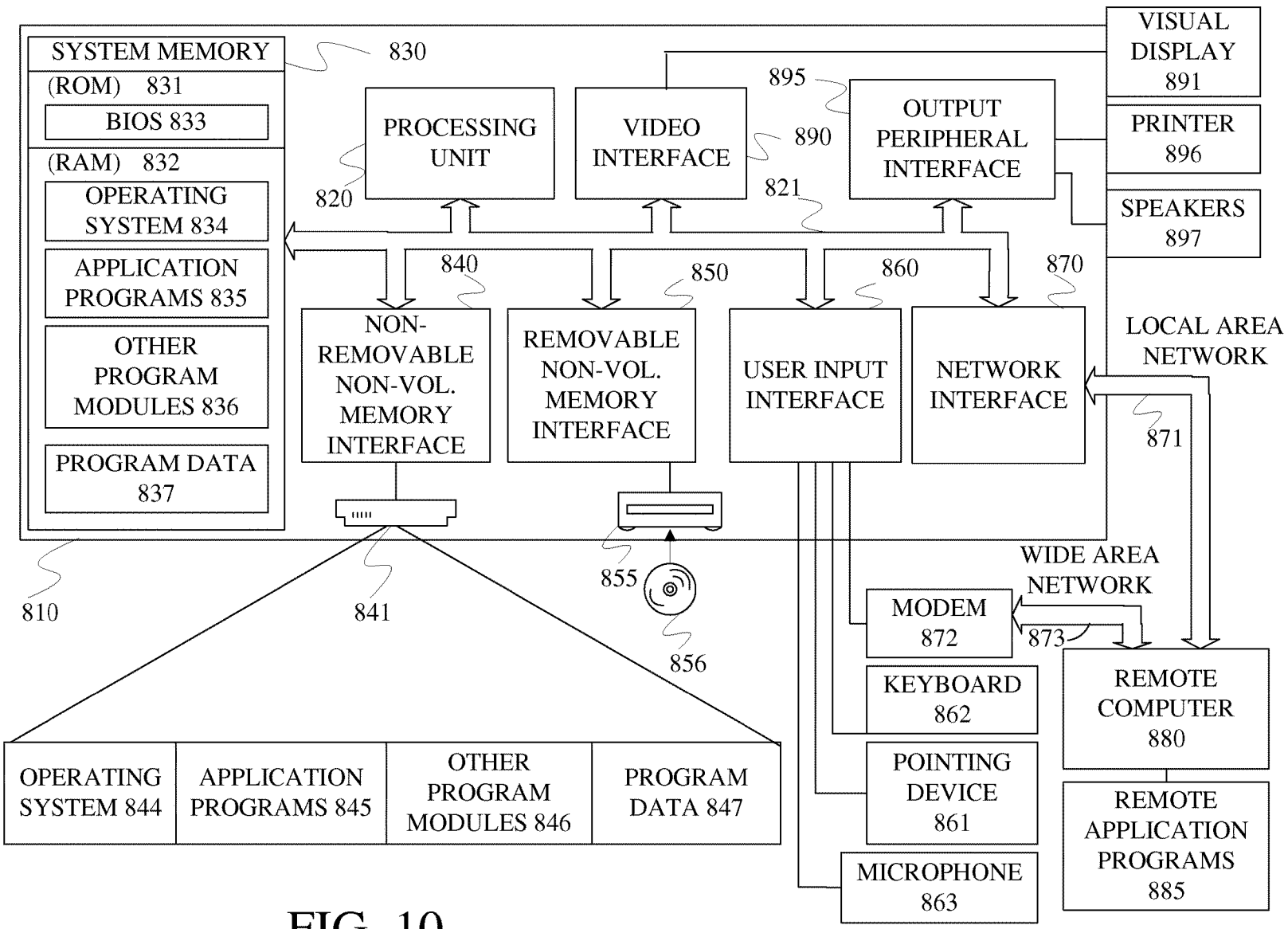
FIG. 10 is a block diagram of one example of a computing environment that can be used in the systems and architectures shown in other figures.

FIG. 10 is one example of a computing environment in which elements of previous FIGS., or parts of it, (for example) can be deployed. With reference to FIG. 10, an example system for implementing some embodiments includes a computing device in the form of a computer 810 programmed to operate as described above. Components of computer 810 may include, but are not limited to, a processing unit 820 (which can comprise processors or servers from previous FIGS.), a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. Memory and programs described with respect to previous FIGS. can be deployed in corresponding portions of FIG. 10.

Computer 810 typically includes a variety of computer readable media. Computer readable media can be any available media that can be accessed by computer 810 and includes both volatile and nonvolatile media, removable and non-removable media. By way of example, and not limitation, computer readable media may comprise computer storage media and communication media. Computer storage media is different from, and does not include, a modulated data signal or carrier wave. Computer storage media includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 810. Communication media May embody computer readable instructions, data structures, program modules or other data in a transport mechanism and includes any information delivery media. The term "modulated data signal" means a signal that has one or more of its characteristics set or changed in such a manner as to encode information in the signal.

The system memory 830 includes computer storage media in the form of volatile and/or nonvolatile memory such as read only memory (ROM) 831 and random access memory (RAM) 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 10 illustrates operating system 834, application programs 835, other program modules 836, and program data 837.

The computer 810 may also include other removable/non-removable volatile/nonvolatile computer storage media. By way of example only, FIG. 10 illustrates a hard disk drive 841 that reads from or writes to non-removable, nonvolatile magnetic media, an optical disk drive 855, and nonvolatile optical disk 856. The hard disk drive 841 is typically connected to the system bus 821 through a non-removable memory interface such as interface 840, and optical disk drive 855 are typically connected to the system bus 821 by a removable memory interface, such as interface 850.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (e.g., ASICs), Application-specific Standard Products (e.g., ASSPs), System-on-a-chip systems (SOCs), Complex Programmable Logic Devices (CPLDs), etc.

The drives and their associated computer storage media discussed above and illustrated in FIG. 10, provide storage of computer readable instructions, data structures, program modules and other data for the computer 810. In FIG. 10, for example, hard disk drive 841 is illustrated as storing operating system 844, application programs 845, other program modules 846, and program data 847. Note that these components can either be the same as or different from operating system 834, application programs 835, other program modules 836, and program data 837.

A user may enter commands and information into the computer 810 through input devices such as a keyboard 862, a microphone 863, and a pointing device 861, such as a mouse, trackball or touch pad. Other input devices (not shown) may include a joystick, game pad, satellite dish, scanner, or the like. These and other input devices are often connected to the processing unit 820 through a user input interface 860 that is coupled to the system bus, but may be connected by other interface and bus structures. A visual display 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 is operated in a networked environment using logical connections (such as a controller area network—CAN, local area network—LAN, or wide area network WAN) to one or more remote computers, such as a remote computer 880.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the Internet. In a networked environment, program modules may be stored in a remote memory storage device. FIG. 10 illustrates, for example, that remote application programs 885 can reside on remote computer 880.

It should also be noted that the different examples described herein can be combined in different ways. That is, parts of one or more examples can be combined with parts of one or more other examples. All of this is contemplated herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A computer implemented method of controlling a work machine, comprising:

generating, with a first control system based on one or more first control system inputs, a first control signal having a first value;

controlling a controllable subsystem on the work machine based on the first control signal generated by the a first control system;

selecting a second control signal to control the controllable subsystem, the second control signal having a second value and being generated by a second control system based on one or more second control system inputs;

generating a variable time-based transition constraint based on the first value and the second value; and controlling a transition from controlling the controllable subsystem with the first control signal to controlling the controllable subsystem with the second control signal based on the variable time-based transition constraint.

2. The computer implemented method of claim 1 wherein generating the variable time-based transition constraint comprises:

generating a transition time period and wherein controlling the transition comprises transitioning from controlling the controllable subsystem based on the first value to controlling the controllable subsystem based on the second value over the transition time period.

3. The computer implemented method of claim 2 wherein generating the variable time-based transition constraint comprises:

identifying a set of aggressiveness criteria; and defining a length of the transition time period based on the aggressiveness criteria.

4. The computer implemented method of claim 3 wherein identifying the set of time-based aggressiveness criteria comprises:

identifying the first control system; and identifying the second control system, and wherein generating the variable time-based transition constraint comprises generating the variable time-based transition constraint based on the first control system and the second control system.

5. The computer implemented method of claim 1 wherein generating the variable time-based transition constraint comprises:

calculating a difference between the first value and the second value; and generating the variable time-based transition constraint based on the difference between the first value and the second value.

6. The computer implemented method of claim 1 wherein selecting a second control signal to control the controllable subsystem comprises:

receiving a subsequent control signal to control the controllable subsystem from the first control system, the subsequent control signal being generated by the first control system after the first control signal;

receiving the second control signal; and running a selection process to select the second control signal to control the controllable subsystem.

7. The computer implemented method of claim 6 wherein running the selection process comprises:

accessing a control system priority indicator that indicates a priority of the first control system and the second control system; and selecting the second control system based on the control system priority indicator.

8. The computer implemented method of claim 6 wherein running the selection process comprises:

running a dynamic selection system to dynamically select the second control system.

9. The computer implemented method of claim 1 and further comprising:

generating feedback to the first control system and the second control system, the feedback identifying the second control system as a selected control system and the second value.

10. A work machine, comprising:

a controllable subsystem;

a first control system configured to receive one or more first control system inputs and to generate, based on the one or more first control system inputs, a first control signal having a first value to control the controllable subsystem;

a second control system configured to receive one or more second control system inputs and to generate, based on the one or more second control system inputs, a second control signal having a second value to control the controllable subsystem;

a machine control supervisor configured to select, as a selected control signal, the first control signal or the second control signal, to control the controllable subsystem;

a time-based transition constraint processing system configured to generate a variable time-based transition constraint based on the first value and the second value; and a control processing system configured to control a transition between controlling the controllable subsystem with the first control signal and controlling the controllable subsystem with the second control signal based on the variable time-based transition constraint.

11. The work machine of claim 10 wherein the first control system comprises:

a manual control system.

12. The work machine of claim 10 wherein the first control system comprises:

an automated control system.

13. The work machine of claim 10 wherein the time-based transition constraint processing system comprises:

a time-based transition constraint generator configured to define a length of a transition time period and wherein the control processing system is configured to control the transition between controlling the controllable subsystem based on the first value and controlling the controllable subsystem based on the second value over the transition time period.

14. The work machine of claim 13 wherein the time-based transition constraint processing system comprises:

an aggressiveness tuning processor configured to identify a set of aggressiveness criteria, the time-based transition constraint generator being configured to generate the variable time-based transition constraint based on the aggressiveness criteria.

15. The work machine of claim 13 wherein the time-based transition constraint processing system comprises:

a difference magnitude processor configured to calculate a difference between the first value and the second value, the time-based transition constraint generator being configured to generate the variable time-based transition constraint based on the difference between the first value and the second value.

16. The work machine of claim 10 wherein the machine control supervisor comprises:

a selection processor configured to receive a subsequent control signal to control the controllable subsystem from the first control system, the subsequent control signal being generated by the first control system after the first control signal, and to receive the second control signal, and access a control system priority indicator that indicates a priority of the first control system and the second control system, the selection processor being further configured to select the second control system based on the control system priority indicator.

17. The work machine of claim 10 wherein the machine control supervisor comprises:

a selection processor configured to run a dynamic selection system to dynamically select the second control system.

18. The work machine of claim 10 wherein the machine control supervisor comprises:

a feedback system configured to generate feedback to the first control system and the second control system, the feedback identifying the second control system as a selected control system and the second value.

19. A processing system, comprising:

a first control system configured to receive one or more first control system inputs and to generate, based on the one or more first control system inputs, a first control signal having a first value to control a controllable subsystem on a work machine;

a second control system configured to receive one or more second control system inputs and to generate, based on the one or more second control system inputs, a second control signal having a second value to control the controllable subsystem;

a machine control supervisor configured to select, as a selected control signal, the first control signal or the second control signal, to control the controllable subsystem;

a time-based transition constraint processing system configured to generate a variable time-based transition constraint based on the first value and the second value; and a control processing system configured to control a transition between controlling the controllable subsystem with the first control signal and controlling the controllable subsystem with the second control signal based on the time-based transition constraint.

20. The processing system of claim 19 wherein the time-based transition constraint processing system comprises:

a difference magnitude processor configured to compute a magnitude of a difference between the first value and the second value;

an aggressiveness tuning processor configured to identify at least one aggressiveness criterion indicative of an aggressiveness with which to transition between controlling the controllable subsystem with the first control signal and controlling the controllable subsystem with the second control signal; and a time-based transition constraint generator configured to define a length of a transition time period over which to transition between controlling the controllable subsystem with the first control signal and controlling the controllable subsystem with the second control signal based on the magnitude of the difference between the first value and the second value and based on the at least one aggressiveness criterion.

* * * * *